US007628290B2

(12) United States Patent
Dagdagan

(10) Patent No.: US 7,628,290 B2
(45) Date of Patent: Dec. 8, 2009

(54) STABILIZING INSULATION SLEEVE FOR BEVERAGE CONTAINERS

(76) Inventor: Leon Dagdagan, 156 Pacer Dr., Vallejo, CA (US) 94591

( * ) Notice: Subject to any disclaimer, the term of this patent is extended or adjusted under 35 U.S.C. 154(b) by 0 days.

(21) Appl. No.: 11/966,730

(22) Filed: Dec. 28, 2007

(65) Prior Publication Data

US 2009/0008438 A1 Jan. 8, 2009

Related U.S. Application Data

(63) Continuation-in-part of application No. 11/369,543, filed on Mar. 8, 2006, now abandoned.

(51) Int. Cl.
*B65D 25/00* (2006.01)
*B65D 90/12* (2006.01)

(52) U.S. Cl. ..... 220/739; 220/628

(58) Field of Classification Search ..... 220/739, 220/738, 737, 632, 631, 630, 629, 628, 694, 220/600, 634; 248/152, 146, 127; 215/395, 215/386; D7/620, 619.1; D9/455, 434
See application file for complete search history.

(56) References Cited

U.S. PATENT DOCUMENTS 568,433 A * 9/1896 Stoddard ..... 417/464
2,063,328 A * 12/1936 Morcom ..... 248/152
4,865,199 A * 9/1989 Zimmer ..... 206/515
D311,477 S * 10/1990 Fallgatter et al. ..... D7/619.1
5,143,247 A 9/1992 Gavle
5,205,473 A 4/1993 Coffin, Sr.
5,259,529 A * 11/1993 Coale ..... 220/739
5,425,497 A 6/1995 Sorensen
5,826,786 A 10/1998 Dickert
5,842,633 A 12/1998 Nurse
6,032,826 A * 3/2000 Libit et al. ..... 220/738
6,053,352 A * 4/2000 Cai ..... 220/739
6,286,754 B1 9/2001 Stier et al.
D448,978 S * 10/2001 Isbell ..... D7/619.1
6,364,151 B1 * 4/2002 Gale ..... 220/738
6,422,456 B1 7/2002 Sadlier
6,562,270 B1 5/2003 Gannon et al.
6,986,438 B2 1/2006 Leung
2005/0056654 A1 * 3/2005 Leung ..... 220/737
2005/0184074 A1 8/2005 Simmons et al.

* cited by examiner

*Primary Examiner*—Anthony Stashick
*Assistant Examiner*—Robert J Hicks

(57) ABSTRACT

For stabilizing a frustoconical beverage container, a stabilizing insulation sleeve comprises a tapered cylindrical sleeve having a plurality of spaced apart vertical slits cut from the smaller open end of such sleeve, forming stabilizing legs. The sleeve is designed to wrap around or nest a similarly shaped, top-heavy, disposable beverage container. The sleeve provides a wide base of support when its legs, formed by the slits, radially expand out to more than 100% of the diameter of the bottom of an inserted beverage cup. This will prevent the inserted cup from easily tipping over on a flat surface, thereby stabilizing it. The ends of the stabilizing legs that spread out on a flat surface can be made of tacky material or of removable adhesive so as to further reduce the problem of sliding across a flat surface.

4 Claims, 5 Drawing Sheets

STABILIZING INSULATION SLEEVE FOR BEVERAGE CONTAINERS

CROSS-REFERENCE TO RELATED APPLICATIONS

This continuation-in-part application Ser. No. 11/369,543, filed Mar. 8, 2006 is filed under 37 CFR 1.53(b), claiming the benefit of my prior nonprovisional application under 35 U.S.C. 120 or 365(c).

PETITION TO MAKE THIS APPLICATION SPECIAL

This application seeks special status under 37 CFR 1.102 because the invention materially enhances the quality of the environment.

BACKGROUND

1. Field of the Invention

This is a continuation-in-part (CIP) application claiming the benefit of my prior application cited above. This invention relates to disposable biodegradable insulation sleeves for drinking cups, specifically insulating sleeves that nest or wrap around disposable beverage cups that can also stabilize the cup when needed.

2. Prior Art

There are thousands of beverage shops in the United States and thousands more in other countries. One coffee outlet alone has more than 14,000 coffee shops in the U.S. and more abroad. The "National Coffee Trends Association" reports that "54% of the adult population drink coffee everyday representing over 110 million daily coffee drinkers. Of these, 20 million drink gourmet coffee beverages every day. Coffee drinkers consume on an average 3.1 cups per day". Most of these coffee drinkers get their coffee from coffee shops that serve them in disposable single walled paper cups. Insulation sleeves are usually provided to nest or wrap around these cups in order to primarily prevent the hands from being burned by the extreme heat of the coffee. Double or triple walled cups are also becoming more popular. These multiple walled cups use an insulation sleeve permanently attached to the outside wall or a middle insulating layer, eliminating the need for sleeves. All these disposable cups are top-heavy and hence unstable because their diameter increases from bottom to top.

The disposable cups are top heavy because, as stated, they are wide on top with a narrow bottom. They are tapered from a larger upper open end to a smaller lower closed end so that they are easy to handle; the pull of gravity and their wider top part prevents them from falling through the grasping hand without undue effort. They are also made that way so that they can be nested for better storage and inexpensive shipping purposes. However, a slight bump can easily knock over an upright beverage cup. But when a cup is inverted, so that the wide top is now on the bottom, it is difficult to knock over.

There are devices that take advantage of the stable attribute of the inverted cup while also providing insulation. U.S. Pat. No. 6,562,270 to Gannon et al', May 13, 2003, shows a cup whose upper part is sliced from its lower portion at about its mid-section, which is discarded. The upper portion is retained for use as a insulator sleeve for a beverage cup and stabilizes it when inverted. The same goes for the cup of U.S. Pat. No. 5,143,247 to Gavle, Sep. 1, 1992, which uses a plurality of frangible recesses positioned horizontally and circumferentially around the device, allowing it to be adapted to a variety of container sizes. U.S. Pat. Pub. Appn. No. 2005/0184074, to Simmons et al', Aug. 25, 2005, uses a cup-like sleeve that is inverted to take advantage of the outwardly rolled rim of the sleeve's larger top end which is inserted into a U-shaped device glued to a surface in order to hold the sleeve in place. This sleeve has slits cut along its upper edge that open up to accommodate the larger upper half of a cup that is inserted to be stabilized on a surface or to be stacked vertically.

Most disposable beverage cups are not insulated. There are cups that are insulated, but they are not as ubiquitous. Instead, sleeves are provided separately by coffee shops, to primarily protect the drinker's hands from the extreme heat of the coffee and secondarily to keep it from losing heat. The insulation sleeves and the cups are generally similar in shape: both are made from blank arcuate paperboard blanks having a convex outer edge and a concave inner edge. When assembled they are frustoconic in shape. The cups have closed bottoms while the insulation sleeves are open at both ends and are made of insulating fiberboards designed to insulate the beverage cup by nesting or wrapping generally around its mid-section. When insulation sleeves are not available, a second cup is used instead: this practice is called "double cupping."

The most popular insulating arrangement is the insulation sleeve that is dispensed by almost all of the coffee houses for insulating the beverage cup, but the top-heavy beverage cups can still easily be tipped over in use and handling.

Numerous insulation sleeves are known and differ mostly by the kind of paperboard insulation material they employ and in how they are assembled. Examples of these insulation sleeves are shown in U.S. Pat. No. 6,286,754 to Stier et al., Sep. 11, 2001; U.S. Pat. No. 5,205,473 to Coffin, Sr., Apr. 27, 1993; U.S. Pat. No. 5,425,497 to Sorensen, Jun. 20, 1995; U.S. Pat. No. 5,842,633 to Nurse, Dec. 1, 1998, and U.S. Pat. No. 5,826,786, to Dickert, Oct. 27, 1998. Most of these insulation sleeves are now used commercially, such as Coffin's which is used primarily by Starbucks and Sorensen's which is used primarily as Java Jacket. U.S. Pat. No. 6,986,438 to Leung, Jan. 17, 2006, shows an insulating cup sleeve made from a flat annular elongated blank with straight top and bottom edges and end edges. This differs from the flat, generally arcuate unitary paperboard blank shown in the aforementioned patents. Leung also has a plurality of transverse slits situated along the upward edge of the sleeve in order to accommodate cups of varying sizes.

Insulated cups are available in either Styrofoam or with double or triple walls, which are becoming more popular, such as U.S. Pat. No. 6,422,456 (Jul. 23, 2002) to Sadlier and assigned to Insulair, Inc. These multiple walled cups use an insulation sleeve permanently attached to the outside wall or a middle insulating layer, eliminating the need for sleeves. In fact the Insulair cup is advertised as the "cup with the built-in sleeve." However, they still easily tip over.

ADVANTAGES

Accordingly, advantages of some of the aspects of the present invention are: To provide an insulation sleeve that uses biodegradable recycled materials, is frustoconic in shape, is simple, and easy to use, and inexpensive, and therefore not that much different to manufacture as compared to prior art sleeves and cups. The present insulation sleeve may be dispensed separately just like known insulation sleeves. They may also be permanently attached to the outside wall of multiple walled cups, making the transition easy. The insulation sleeve is easily converted to a stabilizer for the beverage cup, whenever it is needed, without any extraneous material added to it to make it work, by providing a base whose dimension is greater that the cup's top, similar to the very stable inverted cup.

SUMMARY

According to the present invention, a frustoconic-shaped stabilizing insulation sleeve with both ends open as designed to nest or wrap around a major portion of a tapered beverage cup in order to insulate it. It has at least eight (8) spaced-apart vertical slits extending from its smaller open end towards its middle circumference. It forms at least eight (8) stabilizing legs that when spread out radially on a flat surface expands out to more than 100% of the diameter of the bottom of an inserted beverage cup, providing a wide base of support for the top-heavy tapered beverage cup. It may be permanently attached to the cup or may be dispensed as a separate item, presenting at least two different ways of stabilizing the cup. The ends of the stabilizing legs spread out on a flat surface, and can be made of tacky material or of removable adhesive so as to reduce the problem of sliding. The sleeves are primarily of recycled fiberboard insulating materials.

DRAWINGS

Figure 6:
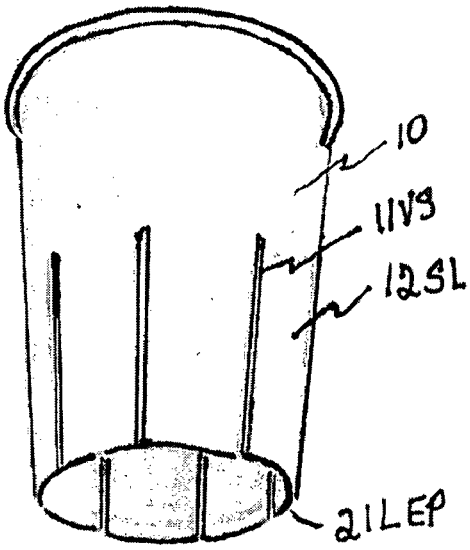

FIG. 6 a stabilizing insulation sleeve according to the invention.

FIRST EMBODIMENT OF THE STABILIZING INSULATION SLEEVE

Figure 7:
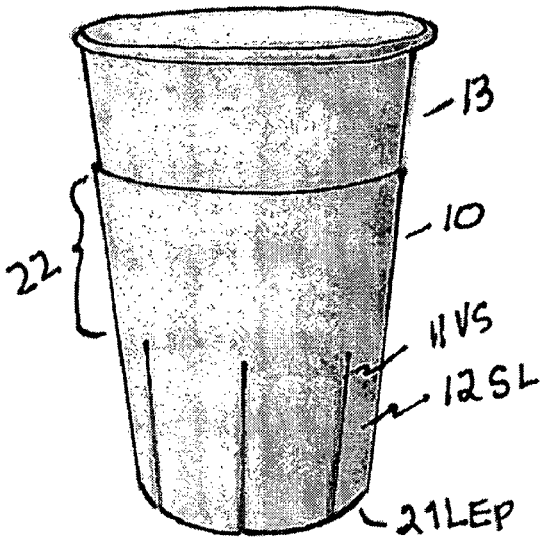

FIG. 7 is a cup nested in a stabilizing insulation sleeve, according to the invention.

Figure 8:
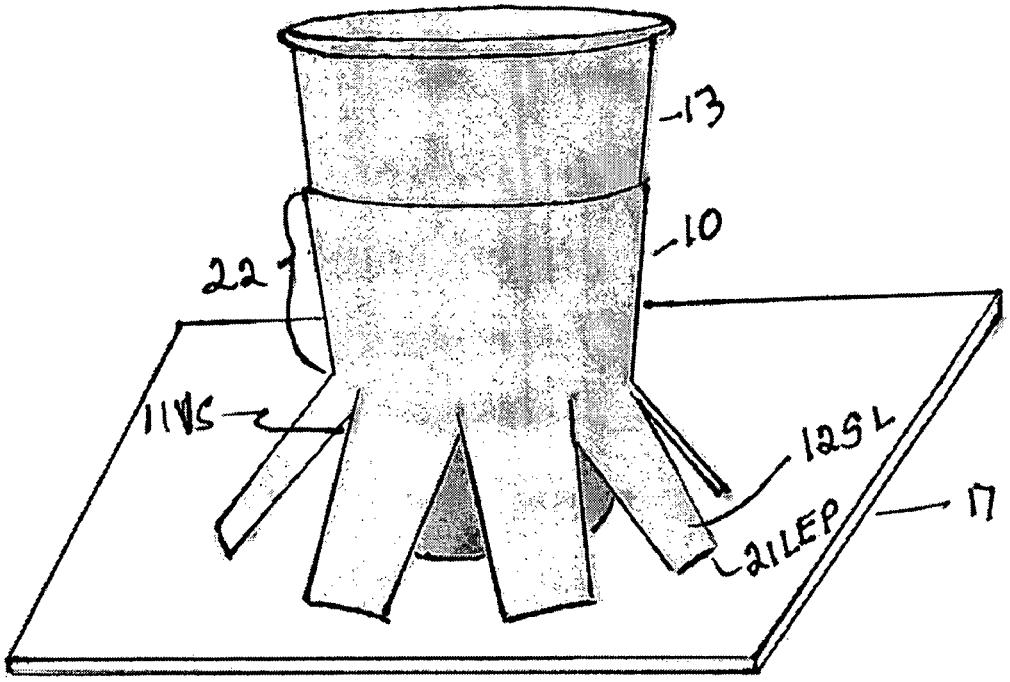

FIG. 8 is a cup in a stabilizing insulation sleeve with its legs spread out radially on a flat surface, according to the invention.

Figure 9:
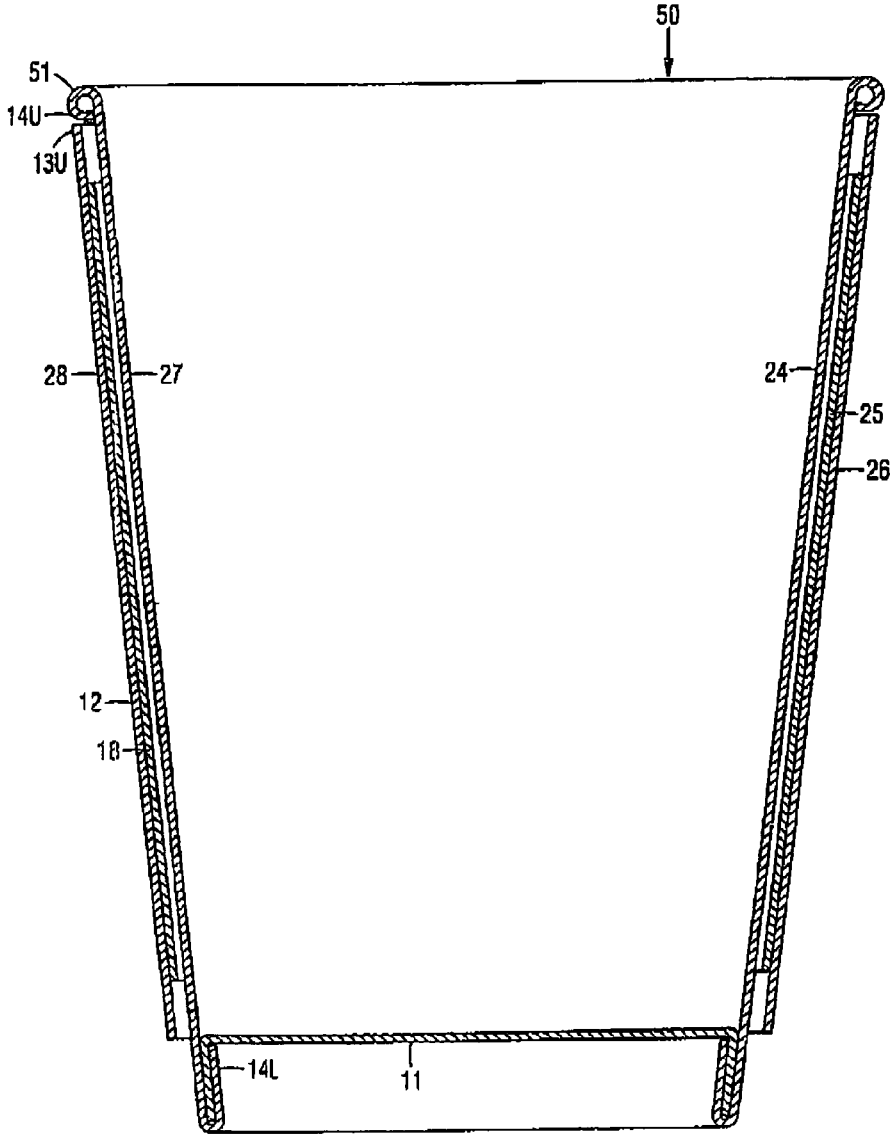
FIG 9 (PRIOR ART)

FIG. 9 Sadlier's invention (prior art).

ALTERNATE EMBODIMENT OF THE STABILIZING INSULATION SLEEVE

Figure 10:
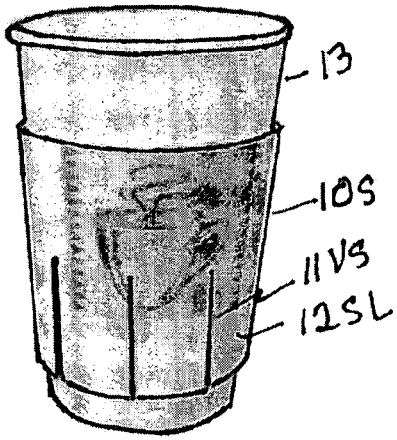

FIG. 10 is a cup nested in a shortened stabilizing insulation sleeve.

Figure 11:
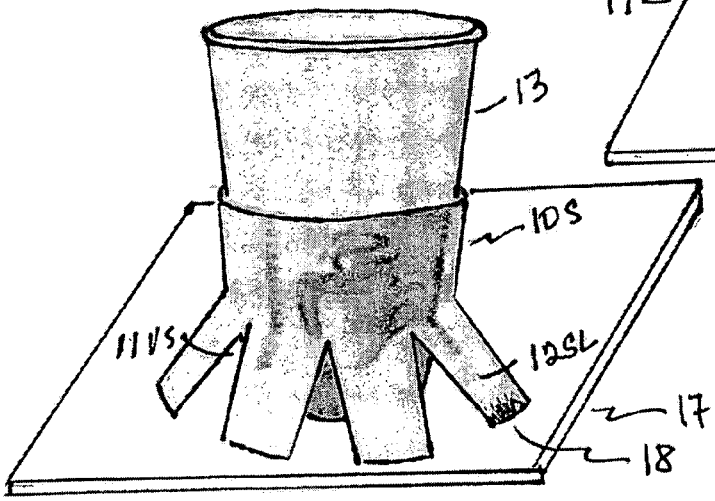

FIG. 11 is a cup nested in a shortened stabilizing insulation sleeve with legs spread out on a flat surface.

Figure 12:
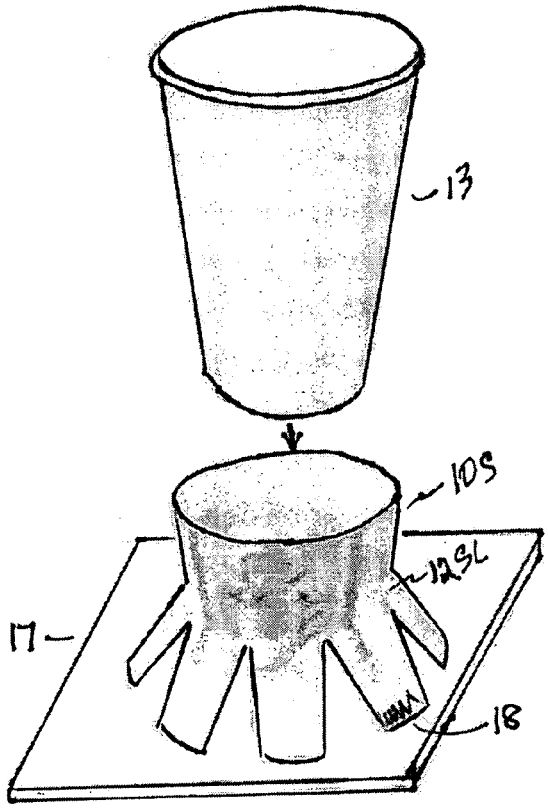

FIG. 12 is a shortened stabilizing insulation sleeve with legs spread out on a flat surface according to the invention

DRAWING REFERENCE NUMERALS

10 Stabilizing insulation sleeve.
10S Shorter stabilizing insulation sleeve.
11VS Vertical slits or cuts that create stabilizing legs.
12SL Stabilizing legs
13 Beverage cup of top heavy, frustoconic shaped, paperboard material
13M Cup's mouth
14 double cupping cup which is made into a stabilizing insulation sleeve 10
17 Flat surface
18 release tape
19 double cupping cup's disk-like bottom
20BR Cup's bottom rim.
21LEP Sleeve's lower end protrusion.
22 section of the sleeve where it can be attached to a cup's wall or middle insulating layer.
24 Where to shorten the stabilizing insulation sleeve.

DETAILED DESCRIPTION

Figure 1:
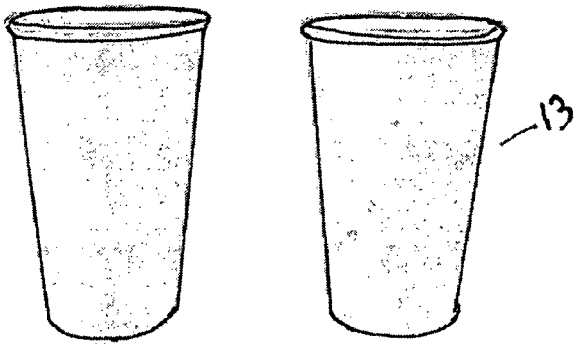
FIG 1 (Prior Art)
FIG. 1 is a top elevation of commonly used, top-heavy beverage cups (Prior Art).
Figure 2:
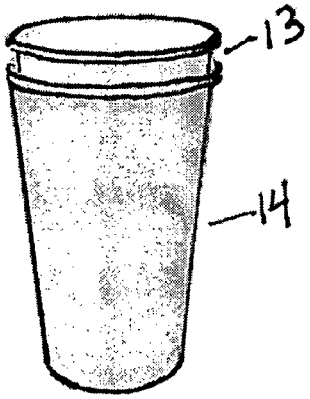
FIG 2 (Prior Art)
FIG. 2 is a top elevation of a beverage cup that is insulated by a second double-cupping cup (Prior Art).

FIGS. 1-2—Prior Art

As stated, this invention relates to a stabilizing device for top-heavy, frustoconic shaped beverage cups, particularly to an insulation sleeve for this purpose. The sleeves are similar in shape and size to the beverage cups and are open at both its ends. They are made from blank arcuate insulating blanks having a convex outer edge and a concave inner edge.

Hot beverages are typically served in top-heavy, frustoconic shaped disposable beverage cups such as cup 13 of FIG. 1.

Insulation sleeves, (not shown) are generally used to insulate the beverage cup. Insulation sleeves are open at both ends and made of recycled biodegradable insulation paperboard material, designed to wrap or nest around the mid-section of the beverage cup. When sleeves are not available, a second "double-cupping" cup 14, FIG. 2, is sometimes used to insulate it. However, the second cup 14 is just another cup that just adds another layer of the same material as the beverage cup, which has very little insulative properties. That is the reason why insulation sleeves are preferably used in the first place.

FIGS. 3-8 Transforming a Cup into a Stabilizing Insulation Sleeve.

To avoid the disadvantages of the above prior-art cups, I use a stabilizing insulation sleeve to insulate as well as stabilize the top-heavy beverage cup. It would be convenient to utilize one of the numerous prior-art sleeves available in coffee shops to show how this invention works but the sleeves as provided by coffee houses are not as suitable for this invention. They can be used, but they are too short to use reliably, because they are primarily designed just short enough to wrap around a small portion of the cup, to protect the user's fingers from being burned by the hot beverage and only secondarily to keep the beverage warm. Hence, these prior-art sleeves cover only about less than half the outside surface of a regular sized coffee cup. For this invention to work properly as an insulation device and also a stabilizer for the cup, the sleeve needs to be longer. I will therefore use a cup, such as the "double-cupping" cup 14, of FIG. 2, for illustrative purposes only, to show how a simple innovation to an insulation sleeve can also stabilize the cup.

Keep in mind that it would be preferable to have a sleeve with insulation properties because the second cup is just that—an uninsulated cup that just adds another layer of uninsulated fiberboard. Existing methods of making cups and sleeves are well established so that manufacturing my stabilizing insulation sleeves should not be that difficult to adapt to the manufacturing process.

Figure 3:
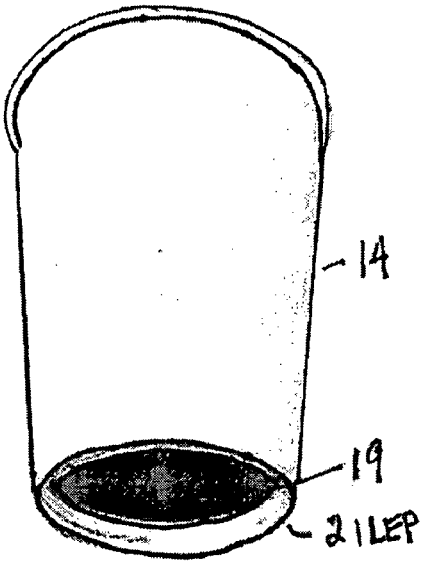
FIG. 3 is the bottom elevation of the second double-cupping cup, bottom blackened.
Figure 4:
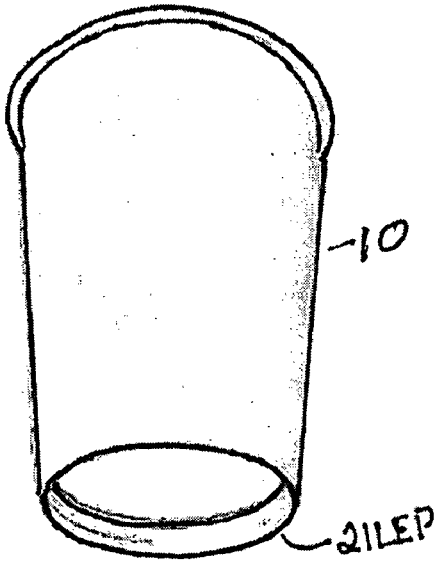
FIG. 4 is the bottom elevation of the second double-cupping cup, turned into a sleeve.

FIG. 3 shows a cup from either FIG. 1 or 2 whose smaller disk-like closed bottom 19 is blackened out for emphasis only. FIG. 4 shows a sleeve 10 that is open at both ends, created by cutting out the blackened disk-like bottom 19 of FIG. 3, making sure not to cut off the cup's bottom rim identified as the lower end protrusion 21LEP, FIGS. 3 AND 4.

This lower end protrusion 21LEP plays an important role in my invention's first embodiment, as the following discussion will show.

Figure 5:
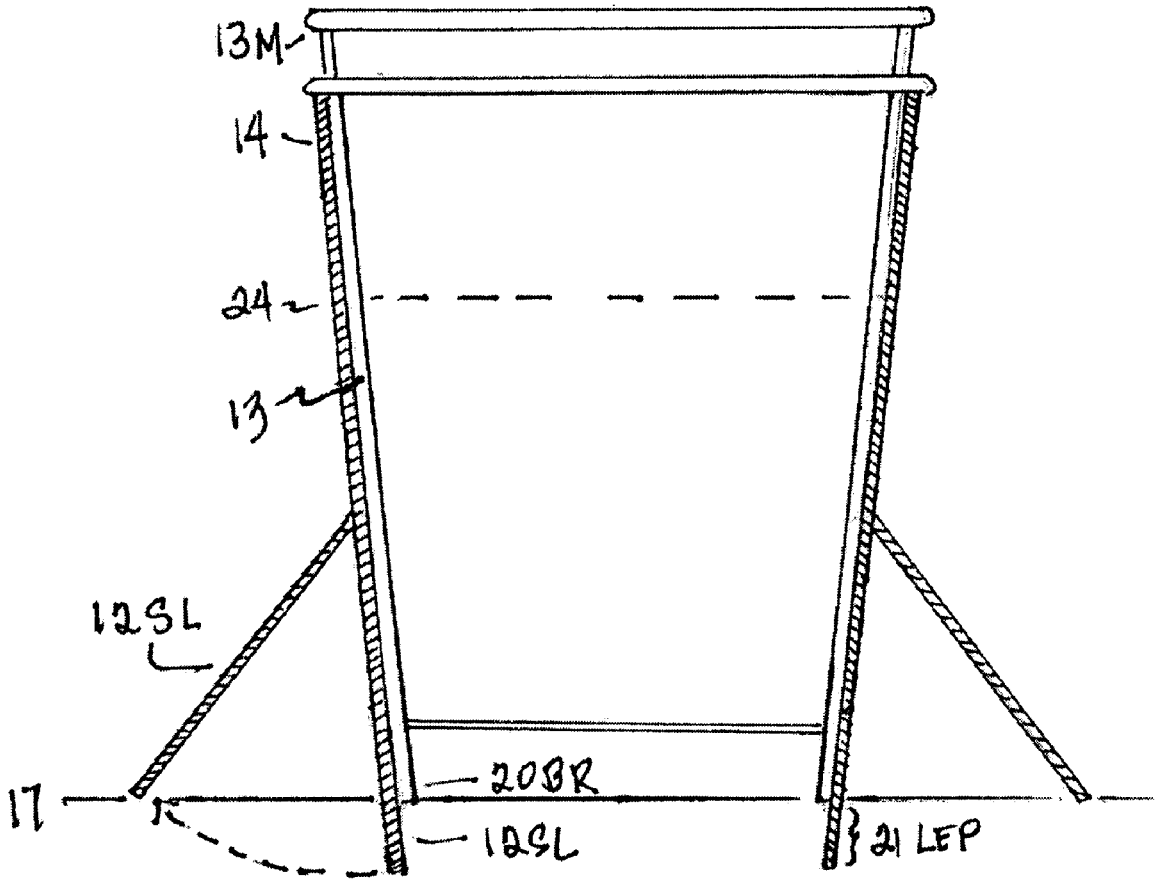
FIG. 5 is a mechanical drawing of a cup nested in a stabilizing sleeve according to the invention.

FIG. 5. In order to understand the significance of the lower end protrusion 21LEP to this invention, and in order to illustrate how the ubiquitous disposable cups are typically arranged in a nesting situation, a mechanical drawing of two nested 16 oz cups is shown, similar to the assembly of FIG. 2. The nested cup's mouth 13M protrudes above the nesting "double-cupping" cup 14. At the lower end, it's the "double-cupping" cup's lower end protrusion 21LEP, that protrudes below the bottom rim 20BR of the nested cup 13. This lower end protrusion, 21LEP, is essential to one embodiment of my stabilizing insulation sleeve invention. Other embodiments do not need this protrusion.

Creating the Stabilizing Insulation Sleeve

FIG. 6. To create a stabilizing sleeve, spaced-apart vertical slits 11VS are cut from the rim of the lower end protrusion 21LEP extending toward the middle portion of the sleeve 10, creating stabilizing legs 12SL. At least eight equally spaced slits 11VS are sufficient. This stabilizing sleeve 10, for all practical purposes, can now be used to both insulate and stabilize the top-heavy frustuconic shaped cup. To conserve on materials, this stabilizing sleeve may be shortened according to the embodiments of this invention.

The First Embodiment of the Stabilizing Sleeve: FIGS. 6, 7, 8

This invention's first embodiment of my stabilizing sleeve may nest a major portion of the cup (no drawing), or may be shortened to about a quarter below its top at about section 24 (broken lines), FIG. 5.

FIG. 7 is an example of the first embodiment of a cup and stabilizing sleeve assembly. The stabilizing sleeve's section 22, where there are no slits, attaches to the outside wall of a cup, 13. The stabilizing sleeve may likewise be attached to a middle insulating layer of triple walled cups (not shown). This assembly shows slits, 11VS, cut vertically from the sleeve's lower end protrusion, 21LEP, extending toward the middle portion of the sleeve 10, creating stabilizing legs, 12SL.

FIG. 8 shows how cup 13 is stabilized on a flat surface 17. Slits 11VS enable stabilizing legs 12SL to radially expand out to more than 100% of the bottom of the beverage cup 13, by using a finger to gently pry them outward from the leg's lower end protrusion 21LEP of sleeve 10, and placed on a flat surface to be stabilized. Cup 13 is stabilized because of the large diameter base provided by the radially spread out stabilizing legs 12SL, quite similar to what a pyramid shaped object provides. Section 22, where there are no slits, provides insulation, just like commonly used insulation sleeves. The stabilizing legs 12SL, when retracted as in FIG. 7, provide additional insulation and can be placed easily in cup holders found in cars.

Referring back to FIG. 5, stabilizing legs, 12SL, protrudes on average, about 13 mm below the cup's bottom rim, 20BR. The lower end protrusion, 21LEP (which varies slightly, in length, according to the size of the cup and the manufacturer) found in most nested paper cups, is necessary to the first embodiment of this invention. The lower end protrusion, 21LEP, makes it possible for the stabilizing legs, 12SL to act as a diagonal brace for the cup 13 when the legs are radially spread out, (as illustrated by the arrow) on a flat surface, and also seen in FIG. 8, in order to provide the wide base needed to stabilize this cup and sleeve assembly. A wider base can be achieved by extending the protrusion, or cutting slits a little bit further up, or both, thereby making stabilizing legs, 12L, longer. It's amazing what a few millimeters longer can do to increase the overall diameter of the stabilizing base.

Multiple-walled insulated cups, such a Insulair's popular triple walled insulated cup (U.S. Pat. No. 6,196,454, Mar. 6, 2001 to Sadlier) FIG. 9 (prior art's drawing), are gaining in popularity. Yet they will still easily tip over. Insulair's cup is a typical arrangement of multiple walled cups, comprising of: the inner layer 24 and 27, middle insulating layer 25 and 18 and an outer layer 26 and 28. My invention's first embodiment assembly can easily be adapted to these cups so that they do not tip over as easily. To do that, outer layer 26 and 28 (the built in sleeve) just needs to be extended below lower edge 14L by about 13 mm, and must have slits and stabilizing legs, according to my invention, in order to prevent these types of cups from easily tipping over. For cups that do not have a lower edge 14L, the sleeve just needs to extend below the closed bottom 11, according to my invention.

Operation

Double or multiple walled insulated cups that use my invention's stabilizing sleeve as its outer layer in the manner just described, will not easily tip over when place on a flat surface, such as a table. To prevent the cup 13 of FIG. 7 nested in sleeve 10 from being easily knocked over while on a flat surface, the user simply uses a finger to pry the stabilizing legs 12SL away from the cup so that the legs are spread out radially. Then the user places the cup on a flat surface so that the legs diagonally extend from the flat surface 17, FIG. 8, providing a stabilizing brace for the cup. This can be carried this way or with the legs retracted as in FIG. 7, which fits easily into cup holders found in cars.

The Alternate Embodiment of Stabilizing the Cup: FIGS. 9, 10, 11

An alternate embodiment of stabilizing the cup has sleeves shortened from both ends as seen in FIG. 10, which may be dispensed separately from the beverage cups, like most of the popular insulation sleeves used today. The shorter stabilizing sleeve 10S is detachably nesting the cup 13 at around the its mid-section.

FIG. 11 shows how the top-heavy, alternate embodiment assembly seen in FIG. 10 is stabilized when stabilizing legs 12SL of sleeve 10S are spread outward by the user, using a finger to gently pry the stabilizing legs outward so that the stabilizing legs 12SL are spread out radially. Then the assembly is placed on a flat surface 17 and sleeve 10S is then pushed down onto the flat surface.

FIG. 12. Alternatively, stabilizing legs 12SL of sleeve 10S can be pried outward radially beforehand and positioned on a flat surface 17, so that cup 13 is stabilized when it is inserted (arrow) into the larger open top of sleeve 10S. The ends of the stabilizing legs 12SL may be of tacky material or have adhesive covered with release tape 18, which can be fastened to the flat surface 17 to prevent the cup and sleeve assembly from sliding.

FIGS. 11 AND 12. Stabilizing legs 12SL, are inclined with respect to surface 17, act and provide support braces for cup 13, thus preventing it from easily tipping over. The detachable shorter sleeve 10S, FIG. 11, can acquire an even greater footprint when it is pushed down further onto surface 17, enabling stabilizing legs 12SL to spread out more. The fit of the shorter sleeve 10S, FIG. 11, around cup 13 is not snug, yet will prevent cup from tipping easily. The cup can easily be lifted out to drink from. Both sleeve 10S and cup 13 can be carried together by simply lifting up the sleeve 10S; cup 13 will fall into place. By grasping sleeve 10S from its bottom portion, legs 12SL will collapse against the outside wall of the beverage cup, providing additional insulation as seen in FIG. 10.

Operation (Alternative Embodiment)

Using the stabilizing insulation sleeve is quite simple. The sleeves are made available on a counter for anyone to use, or the cups can already be nested in the sleeves. The frustoconic shape of the sleeve enables it to be nested for easy shipping and storage. Or if preferred, they can be folded. Since they are similar in shape, the sleeve and cup can also be pre-assembled nested inside one another. This cup and sleeve assembly can easily be carried around this way, placed easily in a car's cup holder, or placed on a flat surface.

When the cup is already nested in the shorter sleeve 10S, FIG. 10, the legs 12SL must first be pried out radially and then placed a flat surface 17, FIG. 11. Then the user pushes the sleeve down so that the legs diagonally extend from the flat surface 17. Another way of stabilizing the cup is to take a shorter stabilizing sleeve 10S and spread the legs outward and set them down on a flat surface 17, FIG. 12. Then the user inserts the cup to be stabilized FIG. 12. The cup can easily be lifted out of the sleeve to drink from.

The ends of the legs may be covered with release tape. The tape then can be fastened to the flat surface to prevent the cup and sleeve assembly from sliding, like when in an airplane or a wobbly coffee cup table.

This assembly can be carried around by simply lifting the sleeve. The cup will fall into place. The user simply grasps the sleeve from the bottom to retract the legs against the wall of the cup. This operation is simple, making the stabilizing sleeve easy to use.

What was just described is how a common disposable fiberboard cup is transformed into a stabilizing sleeve. Existing methods of making cups and sleeves are well established so that manufacturing the stabilizing sleeves should not be that difficult to do The use of slits in industry as a means for particular parts of devices to spread out is well known. However, it is the novel application of slits that distinguishes one invention from another. Slits in the upper part of insulation sleeves allow Simmons' and Leung's invention to accommodate various sizes of cups that are inserted into the sleeve. My invention's sleeve also uses slits, but in a different manner. At least eight (8) slits 11VS, FIGS. 5-11 creates stabilizing legs 12SL, that, when needed radially expand out to more than 100% of the bottom of a beverage cup, as one can see in FIGS. 5, 8, 11 and 12, providing a much wider base of support on a flat surface for the top heavy beverage cup. The sleeve's wall may contain designs or advertisement as illustrated by FIGS. 10-12.

The sleeve's frustoconic shape, best seen in FIGS. 7 AND 10, enables it to be easily nested for shipping and storage. The preferred embodiment cup and sleeve assembly, best shown in FIG. 7, can be pre-packed this way, for easy packing, shipping and storage and eventual use. The alternate embodiment shorter sleeve 10S, FIG. 10, 11, 12 can be folded for storage and shipping, just like the popular prior art insulation sleeves. Ideally, this shortened sleeve should not be folded flat, but instead should be stored fully open and nested in order to maintain a rounded frustoconic shape, because the sleeve stabilizes so much better when it is completely round. However, a previously folded stabilizing sleeve can still stabilize the top-heavy cup.

CONCLUSION, RAMIFICATIONS, AND SCOPE

While the descriptions discussed using a straight utilitarian cut to make slits, the sleeve of this invention may employ slits of varying shapes and designs.

The present sleeve provides stabilizing legs created by spaced apart vertical slits, that when needed, radially expands out to more than 100% of the bottom of the beverage cup, providing a wide footprint or base in order to stabilize an inserted top-heavy frustoconic shaped beverage cup. When closed, these stabilizing legs provide added insulation for the beverage cup nested in the stabilizing insulation sleeve.

Accordingly, advantages of some of the aspects of the present invention are: To provide an insulation sleeve that uses recycled, biodegradable materials, is frustoconic in shape, is simple and easy to use, inexpensive and disposable, and therefore not much different to manufacture. The present insulation sleeve is dispensed just like known insulation sleeves, making the transition easy. The insulation sleeve is easily converted to a stabilizer for the beverage cup, whenever it is needed without any extraneous material added to it to make it work, by providing a much bigger base than its top, similar to the very stable inverted cup.

While the present invention has been described with reference to specific ways to make it, various changes and modifications obvious to one skilled in the art can be made within the purview of this invention.

Examples of Various Modifications are:

A. The ends of the stabilizing legs may have tacky material or adhesive covered with release tape to help prevent the insulation sleeves from easily sliding across a flat surface, like a wobbly coffee shop table.

B. The legs can be reinforced with wire so that they can better maintain their structural integrity.

C. The sleeves can be made of various types of recycled paperboard insulation material or plastic.

D. The sleeves can also be employed to stabilize various frustoconic shaped beverage cups, such as those reusable tapered plastic tumblers used in the non-fast food restaurants and homes. If they fit, bottled and canned beverages can also be stabilized by the sleeves. Different materials can be employed to make the insulation sleeves, provided they are bendable, so that the stabilizing legs can work. They may be made of reusable material.

E. Slits of varying dimensions and designs can be employed in order to make the slits more decorative.

F. The wall of the sleeve can be decorated with different kinds of graphic designs and advertising.

G. The wall of the sleeve can also be folded in a longitudinally zigzag manner along the stabilizing legs in order to provide a means to trap air between the inside wall of the sleeve and the outside wall of the cup in order to improve insulation. Folding also provides ribbing that can contribute to the structural integrity to the stabilizing legs or tabs.

Accordingly, the scope of the invention should be determined not by the embodiments illustrated, but by the appended claims and their legal equivalents.

The invention claimed is:

1. A beverage container with a built-in stabilizing insulation sleeve comprising;

providing a disposable frustoconic beverage container having a closed bottom end and an open top end that is wider than said bottom end;

providing a stabilizing insulation sleeve comprising;

(a) a cylindrical sleeve having a larger open end, a smaller open end, and a tapered frustoconic cylinder wall there between that nests or wraps around a major portion of said disposable frustoconic beverage container;

(b) said smaller end of said cylindrical sleeve extending below rim of said closed bottom end of said container;

(c) said stabilizing insulation sleeve made of insulating material;

(d) said stabilizing insulation sleeve having at least eight (8) spaced-apart vertical slits extending from said smaller open end towards a middle portion of said tapered frustoconic cylinder wall producing at least eight (8) stabilizing legs between said slits;

(e) said beverage container attached to the portion of said stabilizing sleeve where there are no said slits and no said stabilizing legs;

(f) said stabilizing legs being able to radially expand out to more than 100% of the diameter of said container's closed bottom end so that when positioned on a flat surface, said stabilizing legs provide a wide footprint or a base of support for said stabilizing insulation sleeve;

whereby when said beverage container is inserted into said stabilizing insulation sleeve, said sleeve stabilizes said beverage container on a flat surface, and said sleeve and said container are lifted and carried together.

2. A device for stabilizing and insulating top-heavy disposable frustoconic beverage containers, comprising:

(a) a cylindrical sleeve having a larger open end, a smaller open end, and a tapered frustoconic cylinder wall there between that nests or wraps around a major portion of said disposable frustoconic beverage container;

(b) said smaller end of said cylindrical sleeve extending below rim of said closed bottom end of said container;

(c) said stabilizing insulation sleeve made of insulating material;

(d) said stabilizing insulation sleeve having at least eight (8) spaced-apart vertical slits extending from said smaller open end towards a middle portion of said tapered frustoconic cylinder wall producing at least eight (8) stabilizing legs between said slits;

(e) said beverage container attached to the portion of said stabilizing sleeve where there are no said slits and no said stabilizing legs;

(f) said stabilizing legs being able to radially expand out to more than 100% of the diameter of said container's closed bottom end so that when positioned on a flat surface, said stabilizing legs provide a wide footprint or a base of support for said stabilizing insulation sleeve;

whereby when said beverage container is inserted into said stabilizing insulation sleeve, said sleeve stabilizes said beverage container on a flat surface and said sleeve and said container are lifted and carried together.

3. A method for preventing a beverage container from easily tipping over while also providing insulation, comprising;

providing a beverage container having a closed bottom end and an open top end;

providing a stabilizing insulation sleeve that nests or wraps around said container, comprising;

(a) a sleeve having an open top end, an open bottom end, and a cylinder wall there between that nests or wraps around a major portion of said beverage container;

(b) said sleeve's open bottom end extending below rim of said container's closed bottom;

(c) said stabilizing insulation sleeve made of insulating material;

(d) lower half of said sleeve's wall having means to radially expand out to more than 100% of the diameter of said container's bottom; said means are evenly spaced-apart vertical slits extending from said sleeve's bottom end towards a middle portion of sleeve's wall; said slits number at least eight (8) that produce eight (8) stabilizing legs between said slits to provide a wide base for said sleeve; said slits even numbered so that when said sleeve is folded, the folds are in line with said slits;

(e) said beverage container attached to the portion of said stabilizing sleeve where there are no said slits and no said stabilizing legs;

(f) said stabilizing legs radially expand out to more than 100% of the diameter of said container's bottom so that when positioned on a flat surface, said stabilizing legs provide a wide footprint or a base of support for said stabilizing insulation sleeve;

whereby when said beverage container is inserted into said sleeve, said sleeve's lower half having radially expand out prevents said container from easily tipping over when placed on a flat surface, while also providing insulation to said beverage container, and both sleeve and container are carried together.

4. The stabilizing insulation sleeve of claim 3 wherein said sleeve may be dispensed separately from said beverage container.

* * * * *